US007553127B2

(12) United States Patent
Noelle

(10) Patent No.: US 7,553,127 B2
(45) Date of Patent: Jun. 30, 2009

(54) VARIABLE NOZZLE DEVICE

(75) Inventor: Phillipe Noelle, Vincey (FR)

(73) Assignee: Honeywell International Inc., Morristown, NJ (US)

( * ) Notice: Subject to any disclaimer, the term of this patent is extended or adjusted under 35 U.S.C. 154(b) by 518 days.

(21) Appl. No.: 11/452,853

(22) Filed: Jun. 13, 2006

(65) Prior Publication Data

US 2007/0286716 A1 Dec. 13, 2007

(51) Int. Cl.
*F01D 17/16* (2006.01)

(52) U.S. Cl. ..... 415/164

(58) Field of Classification Search ..... 415/159, 415/160, 164
See application file for complete search history.

(56) References Cited

U.S. PATENT DOCUMENTS 5,146,752 A * 9/1992 Bruestle ..... 415/164
7,478,991 B2 * 1/2009 Noelle ..... 415/159

* cited by examiner

*Primary Examiner*—Richard Edgar
(74) *Attorney, Agent, or Firm*—Alston & Bird, LLP

(57) ABSTRACT

A variable nozzle device comprises a wall member 10, a unison ring 12, and a plurality of vanes 1 rotatable about a pivot axle 8 by the unison ring 12. Each vane 1 has a tab member 9 comprising a shaft portion 6 and a tab portion 5 for holding the vanes 1 on the wall member. The nozzle device further comprises an insert 11 for supporting the vanes 1 rotatably about said pivot axle 8.

15 Claims, 11 Drawing Sheets

VARIABLE NOZZLE DEVICE

The invention relates to a variable nozzle device having a wall member and a plurality of vanes, and a method of assembling the variable nozzle device.

Recently developed variable geometry nozzle systems which are employed in turbocharger devices comprise adjustable vanes. Accordingly, such vanes must be positioned in the nozzle of the compressor or the turbine of the turbocharger. Therefore, a variable nozzle cartridge can be provided which includes such vanes which are adjustable. This preassembled variable nozzle cartridge can be mounted to the compressor or turbine of the turbocharger.

As one option of such a variable nozzle cartridge, vanes are disposed between two parallel wall members, i.e. a disk insert or diffuser plate and a backplate. Each vane is pivotally mounted to the backplate by means of a pivot axle of the vane, about which the vane can be rotated. Furthermore, a tab member having an elongated head can be provided integrally at the vane.

In this structure, the pivot axle is arranged in respective holes of the backplate and the tab member is inserted into a respective assembly slot of the backplate as well as into an actuating slot of a unison ring positioned on the back side of the backplate. The backplate according to this known structure also has guide slots, each of which is substantially perpendicular to the associated assembly slot and is connected therewith such that one guide slot and one assembly slot establish a T-shaped slot in the backplate. The guide slots guide shafts on the tab members when the unison ring is rotated in relation to the backplate so as to pivot the vanes.

As a further option, the vanes can be provided with a shaft member and a tab member, wherein the shaft member and the tab member are mounted to a vane body in the course of assembling of the variable nozzle cartridge. This means, that the shaft member and the tab member are mounted to the vane body such that the shaft member is positioned in a slot of the wall member and in a slot of the unison ring.

It is the object of the present invention to provide a variable nozzle device having an enhanced performance and a reduced number of components the assembly thereof being facilitated.

According to a first aspect of the present invention, a variable nozzle device comprises a wall member, a unison ring, and a plurality of vanes rotatable about a pivot axle by said unison ring, wherein each vane has a tab member comprising a shaft portion and a tab portion for holding said vane on said wall member, further comprising an insert for supporting said vane rotatably about said pivot axle.

According to the basic concept of the present invention, the variable nozzle device comprises said wall member which guides a movement of each vane and further comprises an insert which supports said vanes rotatably about said pivot axle. The insert is designed in order to be arranged at the wall member.

According to this aspect of the present invention, the variable nozzle device can be formed by arranging said vanes on a single wall member, wherein said vanes comprise tab members engaging with said wall member. Providing an insert to be arranged at the wall member enables the mounting of the vanes to the wall member and, thereafter, mounting of the insert for completing the variable nozzle device.

The construction according to this aspect of the present invention enables the use of integrally formed vanes as preassembled vanes.

According to a preferable form of the present invention, said insert is press-fitted to said wall member. The insert is mounted to the wall member in the course of the assembly of the variable nozzle device. Once the insert is mounted to the variable nozzle device, it is not necessary to separate the wall member and the insert from each other. Rather, the wall member and the insert are secured to each other by press-fitting the wall member and the insert. In addition, an accurate alignment of the insert with respect to the wall member along the rotational axis thereof can be achieved.

According to a further preferable form of the present invention, said insert is arranged radially inside of said wall member. According to this preferable form, the pivot axle of the vane is arranged radially inside of said wall member, which provides a sliding support of the tab member of the vanes. Therefore, the vanes can be arranged in a radial direction with respect to the wall member and the insert.

According to a further preferable form of the present invention, the insert comprises holes for rotatably supporting said pivot axles. Holes can be machined by a simple process, and the assembly of pivot axles and holes can be performed by a simple process.

According to a further preferable form of the present invention, said wall member comprises guide slots for guiding the shaft portions of the vanes. The guide slots enable the shaft portion of the tab member to be guided and, in addition, enable the tab portion to engage with one face of the wall member in order to hold the vanes on the other face of the wall member.

According to a further preferable form of the present invention, the tab portions are insertable to said guide slots and capable of abutting against said wall member so as to restrict a movement of said vanes relative to said wall member in the axial direction with respect to said shaft portions. Thereby, the wall member is gripped by the tab portions and the vanes.

According to a further preferable form of the present invention, the tab portions protrude form said wall member on the side opposite to the vanes and are engageable with said unison ring. Thereby, the tab portions serve as actuatable portions of the vanes which engage with the unison ring.

According to a further preferable form of the present invention, the unison ring comprises actuating slots for engaging with said tab portions in order to actuate said vanes by rotating the unison ring relatively to said wall member. That is, by rotating the unison ring relative to the wall member, the vane members are rotated about the pivot axles by moving the tab portions in the actuating slots.

According to a further preferable form of the present invention, an inner circumferential surface of the unison ring is in sliding contact with an outer circumferential surface of said insert. Since the insert is aligned with the axis of the wall member, the unison ring is aligned with both said insert and said wall member due to the sliding contact there between. Thereby, an accurate movement of the unison ring with respect to the wall member is enabled.

According to a further preferable form of the present invention, said insert comprises a flange protruding from said outer circumferential surface of said insert, the diameter of said inner circumferential surface of said unison ring being smaller than the outer diameter of said flange. Providing such a flange enables the moveable support of the unison ring with less parts. Further, a failure of the unison ring, for example by detaching of the unison ring from the remaining parts, is impossible by providing the flange on the insert which is, in turn, press-fitted to the wall member.

According to a further preferable form of the present invention, the tab portions are formed with a shape which corresponds to the shape of said actuating slots. Thereby, the actuating of the vanes by rotating the unison ring can be achieved with a high degree of accuracy. Further, the response behaviour of the mechanical system is enhanced by providing corresponding shapes of the tab portions and of the actuating slots.

According to a further preferable form of the present invention, the insert comprises a stepped surface, the diameter of which is smaller than that of the outer circumferential surface of the insert, wherein said stepped surface is engaged with the inner circumferential surface of the wall member. Providing such a step facilitates the assembly of the variable nozzle device. That is, in the process of press-fitting of the insert into the wall member, the axial alignment of the insert and the wall member is secured upon abutment of the step with the face of the wall member. Therefore, the insert only has to be pushed into the wall member up to the limit to make sure that the correct position is achieved.

According to a further preferable form of the present invention, faces of the wall member and of the insert on the side of the vane are substantially flush. The vane body is arranged on a face formed by the wall member and the insert. That is, the vane body extends from the wall member to the insert. Providing a wall formed by the wall member and the insert without any step by forming the faces of the wall member and of the insert which are substantially flush, provides a plane surface on which the vane is arranged. Such an arrangement simplifies the shape of the vane body since it is not required to adapt the vane body to any steps or different levels formed on the face formed by the wall member and the insert.

According to a further preferable form of the present invention, the tab member, which comprises the shaft portion and the tab portion, are formed integrally with the vane. Forming elements integrally reduces the number of components used in the structure. In particular, the constitution of this aspect of the present invention enables the use of such a vane including the tab member integrally.

According to a further preferable form of the present invention, the guide slots are open towards the inner circumferential surface of the wall member. Such a structure further facilitates the assembly of the variable nozzle device, since the shaft portions of the tab member can be introduced from the open ends of the guide slots.

According to a further aspect of the present invention, a compressor comprises a variable nozzle device according to the preceding aspect, wherein a housing wall of the compressor and the wall member of the variable nozzle device form an annular passage. That is, the variable nozzle device can be arranged in the compressor facing to a housing wall thereof. The annular passage formed between the housing wall of the compressor and the wall member of the variable nozzle device includes the vanes which are adjustable based on the rotation of the unison ring. Preferably, the vanes are not in contact with the housing wall of the compressor.

According to a further aspect of the present invention, a turbocharger comprises a compressor according to the above-mentioned aspect. A turbocharger comprising a compressor in which a variable nozzle in the above-mentioned arrangement is mounted, provides an enhanced performance while the number of components is reduced and the assembly thereof is facilitated.

According to a further aspect of the present invention, a method of assembling a variable nozzle device having the above-mentioned structure comprises the steps of arranging the shaft portions of said vanes in the respective guide slots, arranging the unison ring on the wall member while accommodating the tab portions in the actuating slots, and arranging the insert at the inner circumferential surface of the wall member while accommodating the pivot axles of the vanes in the holes formed in the insert.

According to a further preferable form of the present invention, the method of assembling the variable nozzle device, the insert is press-fitted into the inner circumferential surface of the wall member.

According to a further preferable form of the present invention, in the method of assembling a variable nozzle device, after arranging the shaft portions of the vanes in the respective guide slots, the vanes are rotated and positioned such that the tab portions are insertable into said actuating slots of the unison ring.

The above mentioned aspects of the present invention can be employed independent or combined with each other. The features and advantages of the invention will be come apparent from the following description with reference to the enclosed drawings.

FIG. 1 is a cross-sectional view of a compressor housing and a center housing wherein a variable nozzle device having pivotable vanes according to an embodiment of the invention is mounted there between;

An embodiment of the present invention is explained in the following based on the attached drawings.

Figure 1:
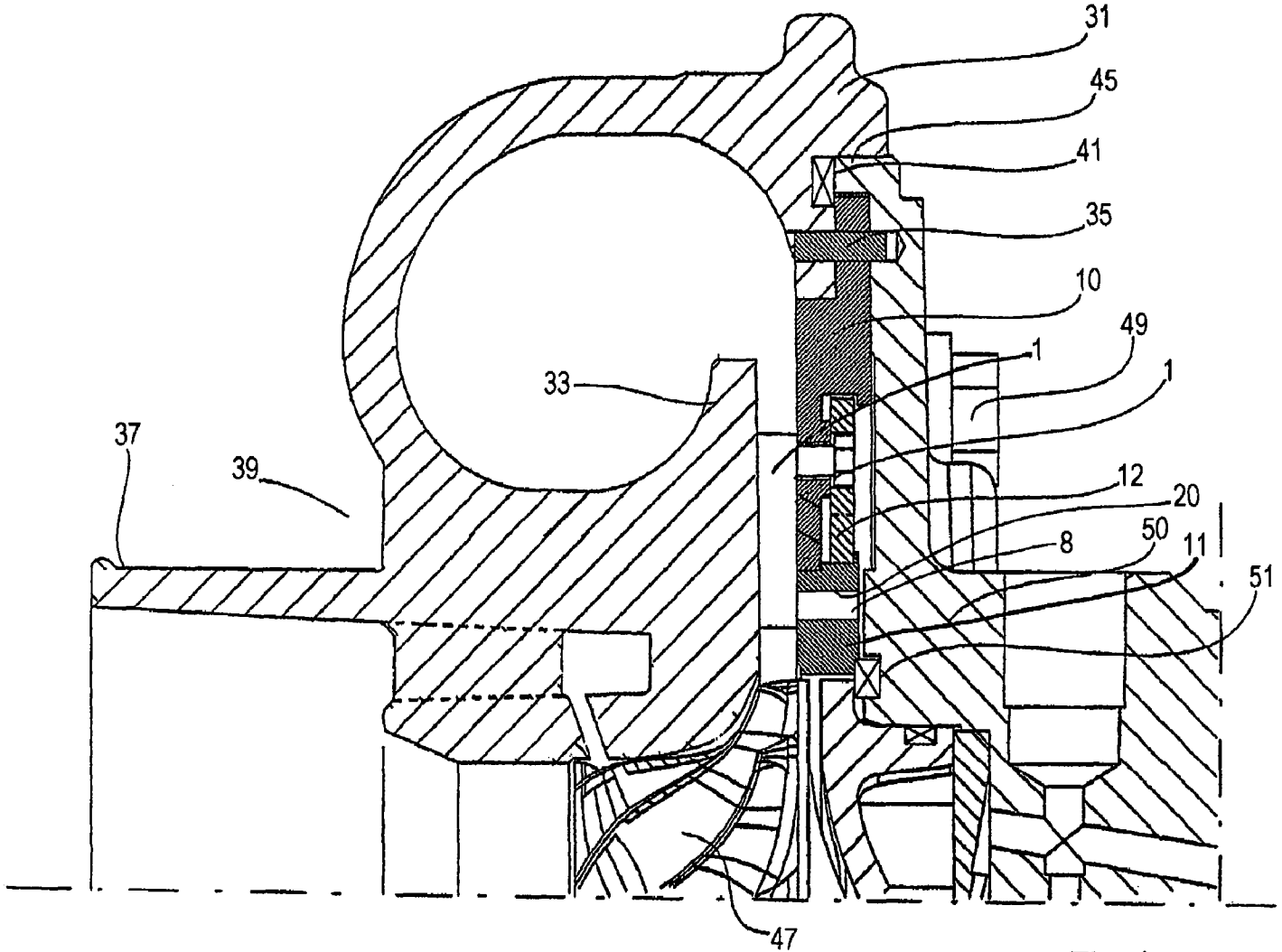

FIG. 1 shows a cross-sectional view of a portion of a compressor housing and a center housing of a turbocharger having a variable nozzle device according to an embodiment of the invention. Inlet air is compressed by a compressor wheel 47 through a nozzle into a volute. The nozzle is formed between a nozzle portion 33 of the compressor housing and a wall member 10 including an insert 11.

Pivotable vanes 1 are provided in the nozzle and the cross-sectional area of the nozzle can be adjustable by pivoting the vanes 1. A unison ring 12 is provided on the side of the wall member 10 opposite to the vanes 1, and the vanes 1 are actuated by a later described actuating mechanism according to which the unison ring 12 is rotated relatively to the wall member 10.

Figure 2:
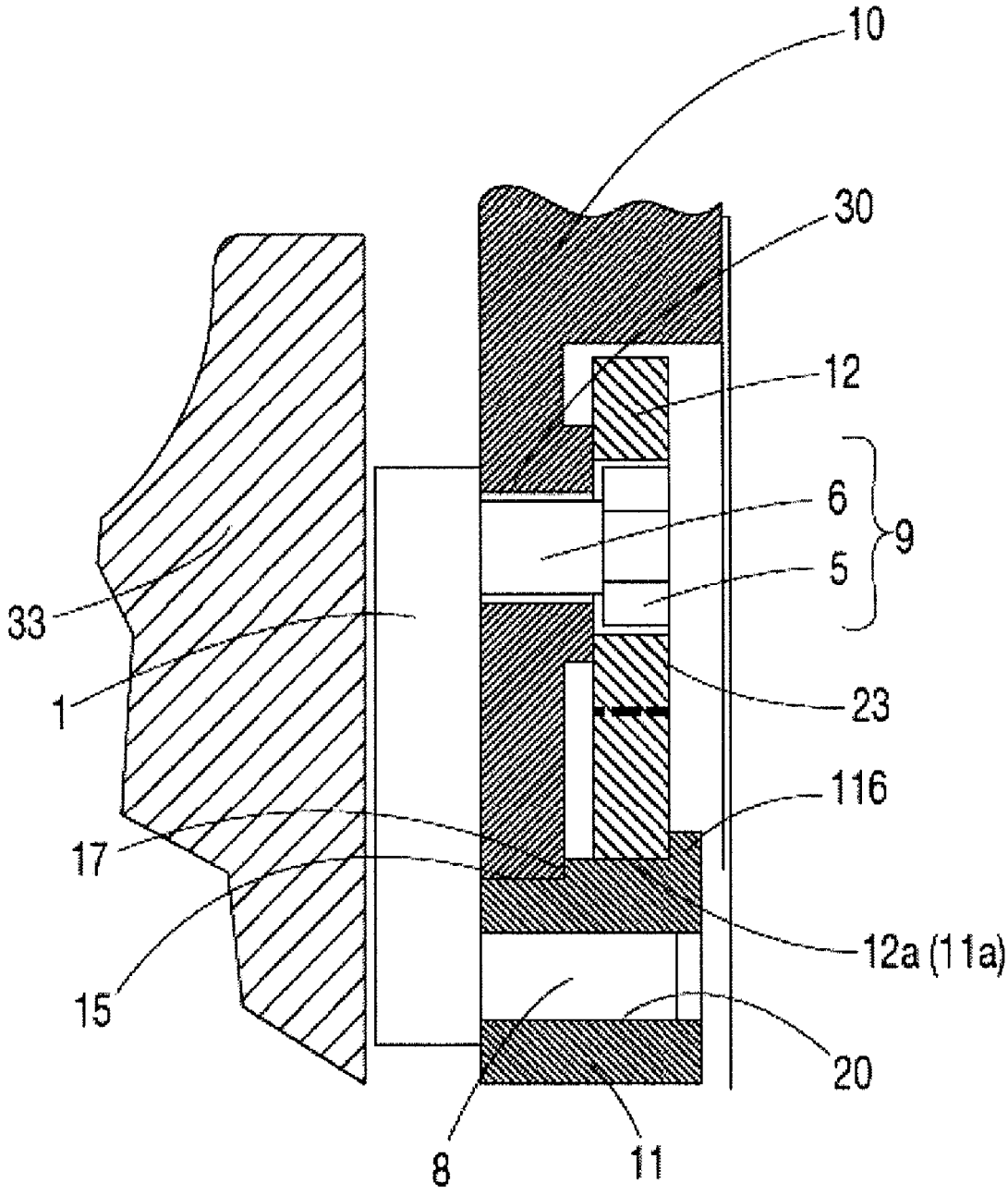
FIG. 2 is a cross-sectional view showing the variable nozzle device more detailed in a mounted condition.

FIG. 2 shows the variable nozzle device of FIG. 1 in a more detailed view. As can be derived from FIG. 2, the variable nozzle device is provided in opposition to the nozzle portion (compressor wall member) 33 without being in contact with a surface thereof. That is, the vanes are provided in an annular gap formed between the compressor housing wall 33 and the wall member 10 of the variable nozzle device.

The variable nozzle device is supported by the center housing 50 shown in FIG. 1. In particular, the wall member 10 of the variable nozzle device is fixedly mounted to the volute 31 at a radial outer portion of the wall member 10. In this way, the wall member 10 projects into a circular groove provided in a radial outer portion of the volute 31. At the bottom of this circular groove, a seal 41 is provided, which is capped in position by means of the wall member 10.

The variable nozzle device according to the present invention, as disclosed in FIG. 2, comprises the above-mentioned wall member 10, a plurality of vanes 1, a unison ring 12 and an insert 11. As can be derived from FIG. 2, the insert 11 is disposed radially inside of the wall member 10. In particular, the insert 11 is press-fitted into the wall member 10.

The wall member 10 comprises a plurality of guide slots 30 for accommodating a portion of each vane 1. In particular, a tab member 9 penetrates each guide slot 30 such that a shaft portion 6 is guided by the guide slot 30. The tab member 9 further comprises a tab portion 5 which is arranged on the opposite side with respect to the vane body of the vane 1 in the assembled condition.

A unison ring comprises actuating slots 23 which engage with said tab portions 5. The unison ring is rotatably supported by the insert 11. In particular, the inner surface 12*a* of the unison ring 12 is in sliding contact with the radial outer surface 11*a* of the insert 11.

The insert 11 comprises holes 20 for accommodating pivot axels 8 of the vanes.

In the following, the vanes 1 arranged in the variable nozzle device according to embodiment of the present invention are described based on FIG. 3A and FIG. 3B.

Figure 3A:
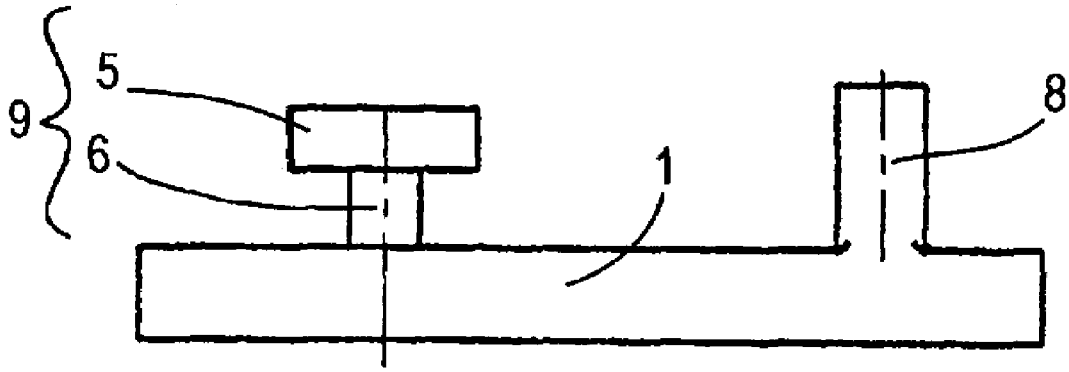
FIGS. 3A and 3B are views of a vane according to an embodiment of the invention.

FIG. 3A is a side view of a vane 1 which is used in the variable nozzle device of the embodiment of the present invention. The vane comprises the pivot axle 8 and the tab member 9. The tab member 9 and the pivot axle 8 extend from the same face of the vane body of the vane 1. The tab member and the pivot axle 8 are spaced by a predetermined distance. The tab member 9 comprises the shaft portion 6 and the tab portion 5. The shaft portion 6 directly disposed on the vane body of the vane 1 and extends there from. At the end of the shaft portion 6, the tab portion 5 is arranged. The cross-sectional area of the tab portion 5 is larger than that of the shaft portion 6.

The pivot axle 8 is basically a cylindrical protrusion extending from the vane body of the vane 1. The pivot axle 8 is adapted to be supported in a circular hole and to be rotated therein.

Figure 3B:
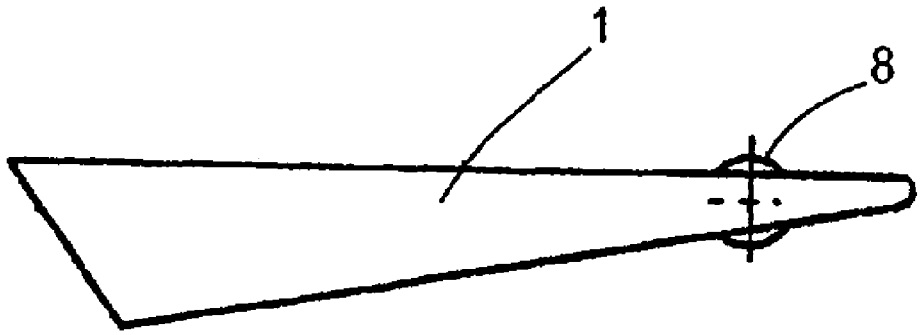

FIG. 3B is a view of the vane 1 in the direction of an arrow A in FIG. 3A. The vane according to the embodiment of the present invention is basically triangular wherein the pivot axle 8 is arranged at the acute portion of the vane body. The base end of the body of the vane 1 is provided at the side of the tab member 9.

Figure 4:
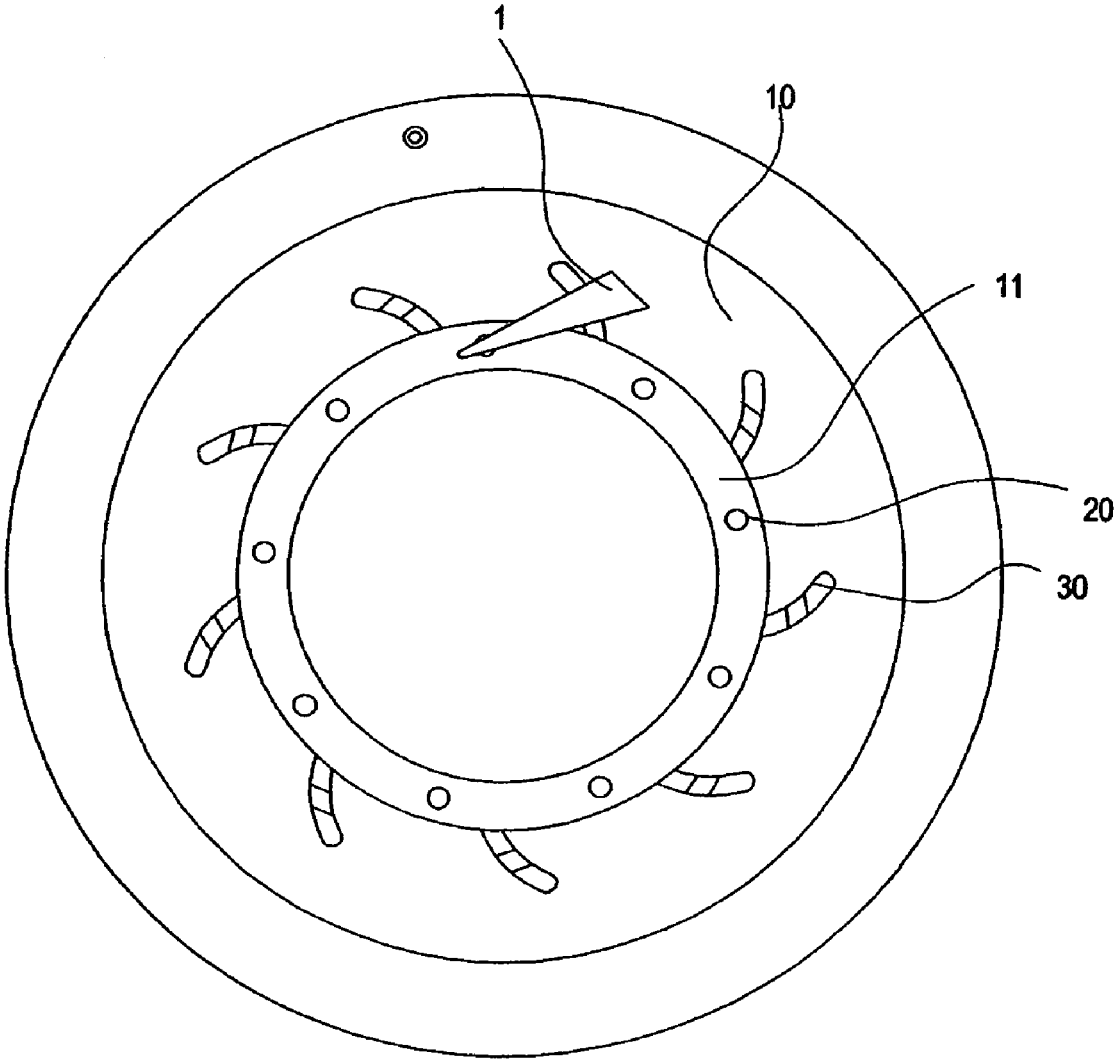
FIG. 4 shows the side of the variable nozzle device which faces towards the compressor in a mounted condition.

FIG. 4 is a view of the variable nozzle device, wherein only one single vane 1 is mounted thereto. In reality, a plurality of vanes 1 are mounted to the variable nozzle device corresponding to the number of guide slots 30 arranged in said wall member 10.

The wall member 10 has a circular shape and is provided with said guide slots 30 which are open to the inner circumferential surface of said wall member. The insert 11 is press-fitted into the inner circumferential surface of the wall member 10. The insert comprises a number of holes 20 which corresponds to the number of vanes 1 to be arranged.

Figure 5:
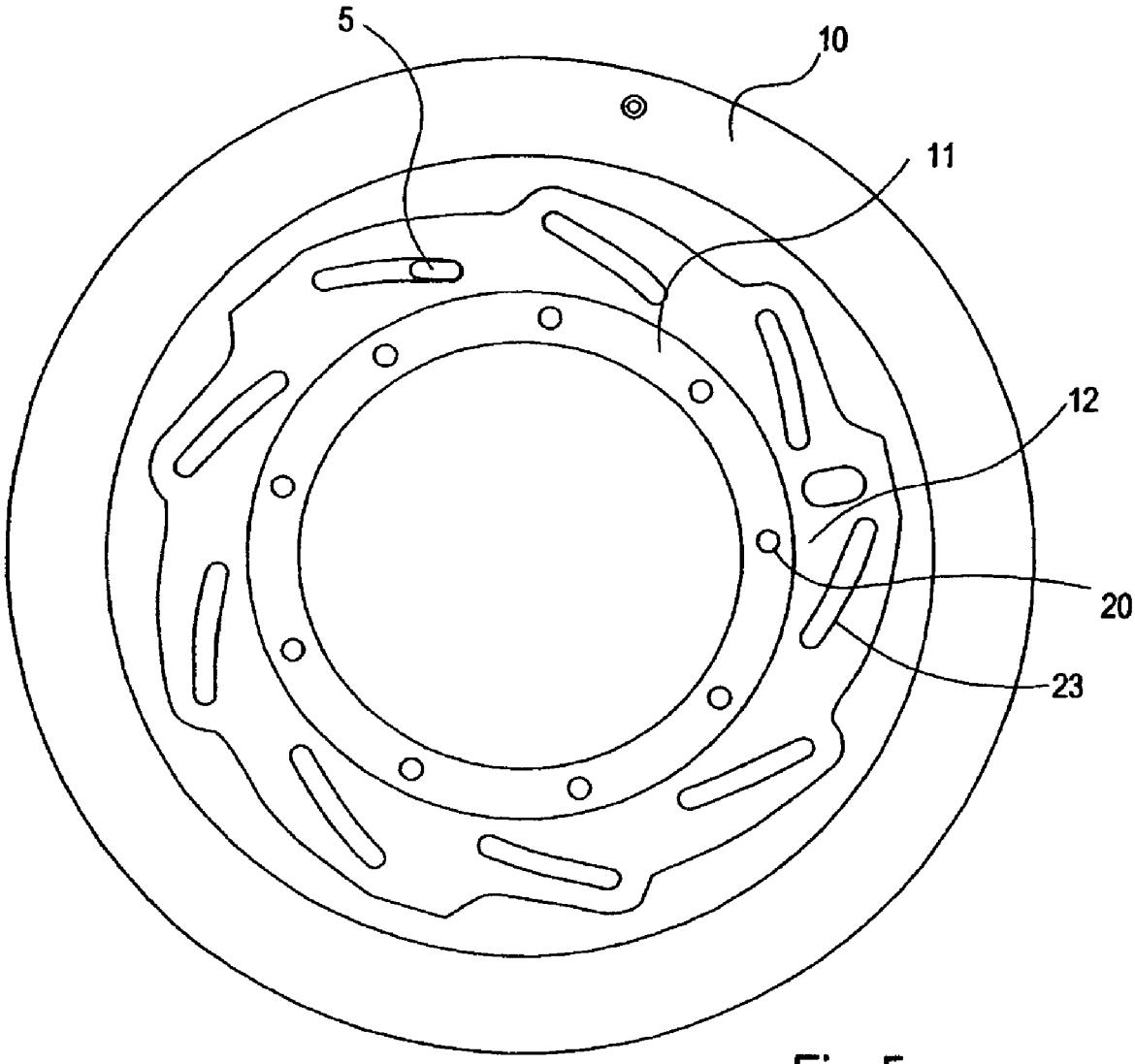
FIG. 5 shows the side of the variable nozzle device of the embodiment of the present invention which faces towards the center housing of the turbocharger.

As shown in FIG. 5, the tab member 9, in particular, the tab portion 5, of the vane 1 is engaged with the actuating slot 23 of the unison ring 12. The unison ring 12 is arranged in an annular groove provided at the wall member 10. The insert 11, which is press-fitted into the wall member 10 rotatably supports the unison ring 12.

Figure 6:
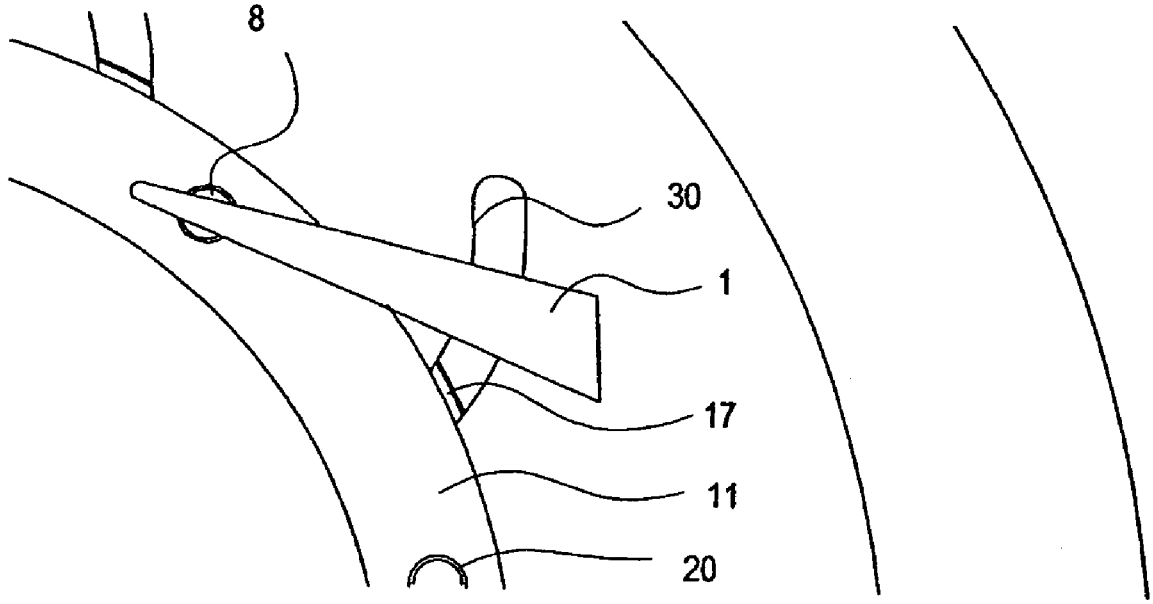
FIG. 6 shows the mechanism of the variable nozzle device according to the present invention in a more detailed view.

FIG. 6 shows the arrangement of the vane 1 at the wall member 10 and the insert 11 in a more detailed view. The pivot axle 8 of the vane 1 is accommodated in the hole 20 formed in the insert 11. Thereby, the vane 1 is pivotably supported about the pivot axle 8. The guide slot 30 formed in the wall member 10 is designed so as to guide the vane 1 while being pivoted about said pivot axle 8.

Figure 7:
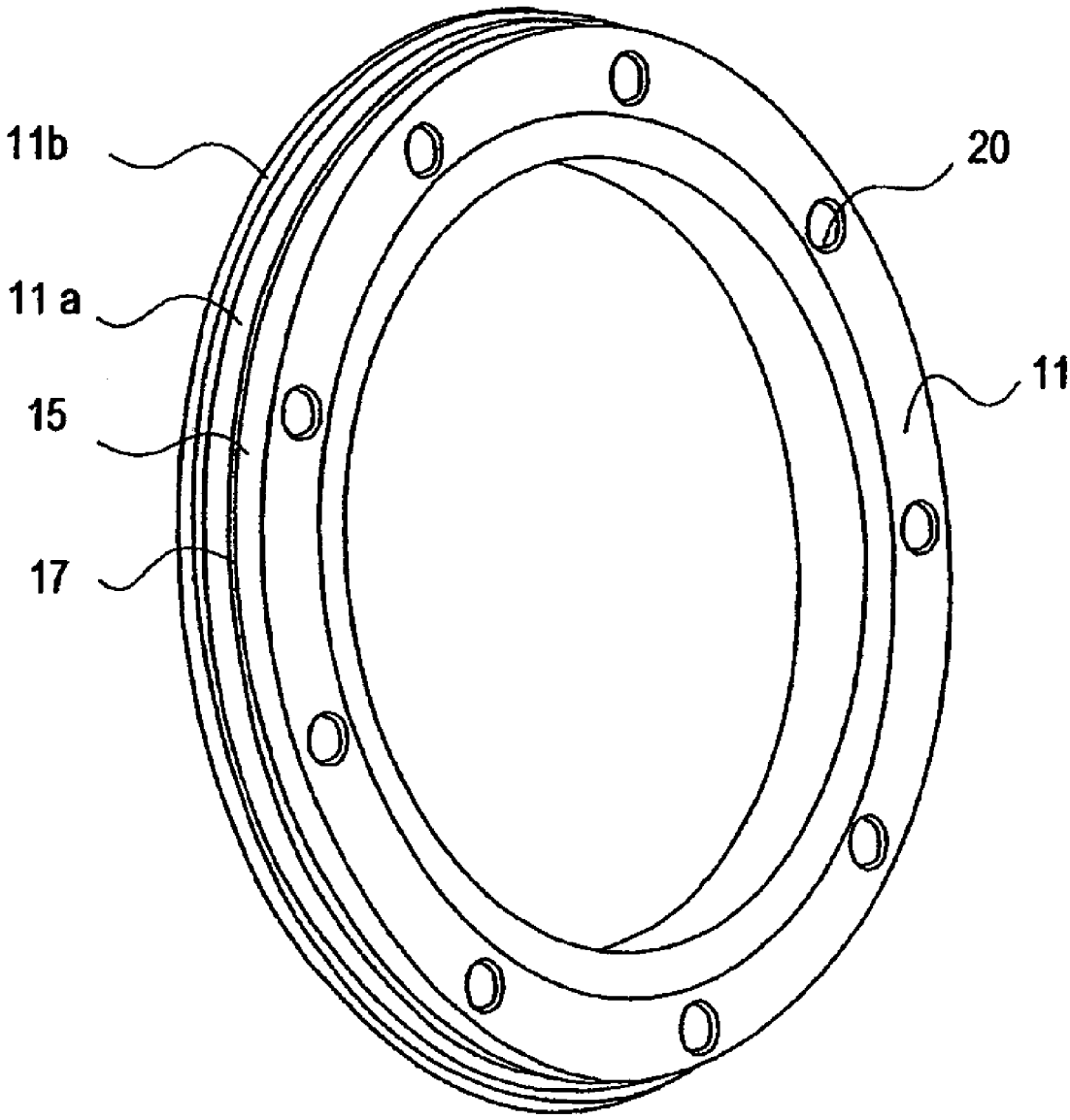
FIG. 7 shows the insert according to the embodiment of the present invention in an elevational view.

FIG. 7 shows the insert 11 before being mounted to the variable nozzle device according to the embodiment of the present invention. The insert 11 is a circular ring shaped body having an outer circumferential surface 11*a* and a plurality of above-mentioned holes 20 which extend in the axial direction of the ring shaped body of the insert 11. The outer circumferential surface comprises a stepped surface 15, the outer diameter of which is smaller than the outer diameter of the circumferential surface 11*a*. Between the surfaces 11*a* and 15, a step 17 is formed. On one side of the insert 11, a flange 11*b* is formed. The outer diameter of the flange 11*b* is greater than the outer diameter of the surface 11*a*. The diameter of the outer circumferential stepped surface 15 is formed such that a press-fitting arrangement between the stepped surface 15 and the inner circumferential surface of the wall member 10 can be formed.

Figure 8:
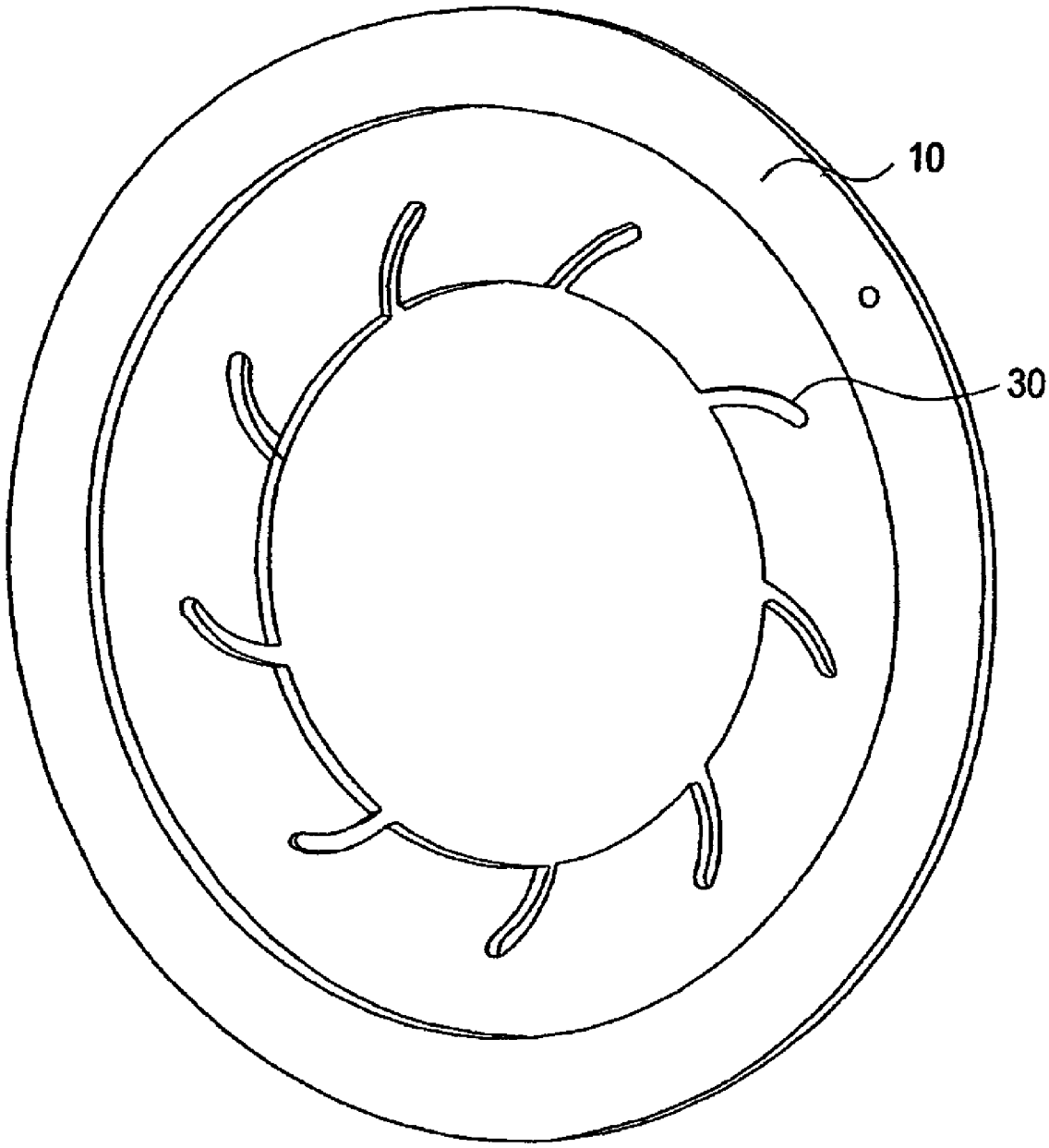
FIG. 8 shows the wall member as prepared for the assembly of the variable nozzle device according to the embodiment of the present invention.
Figure 9:
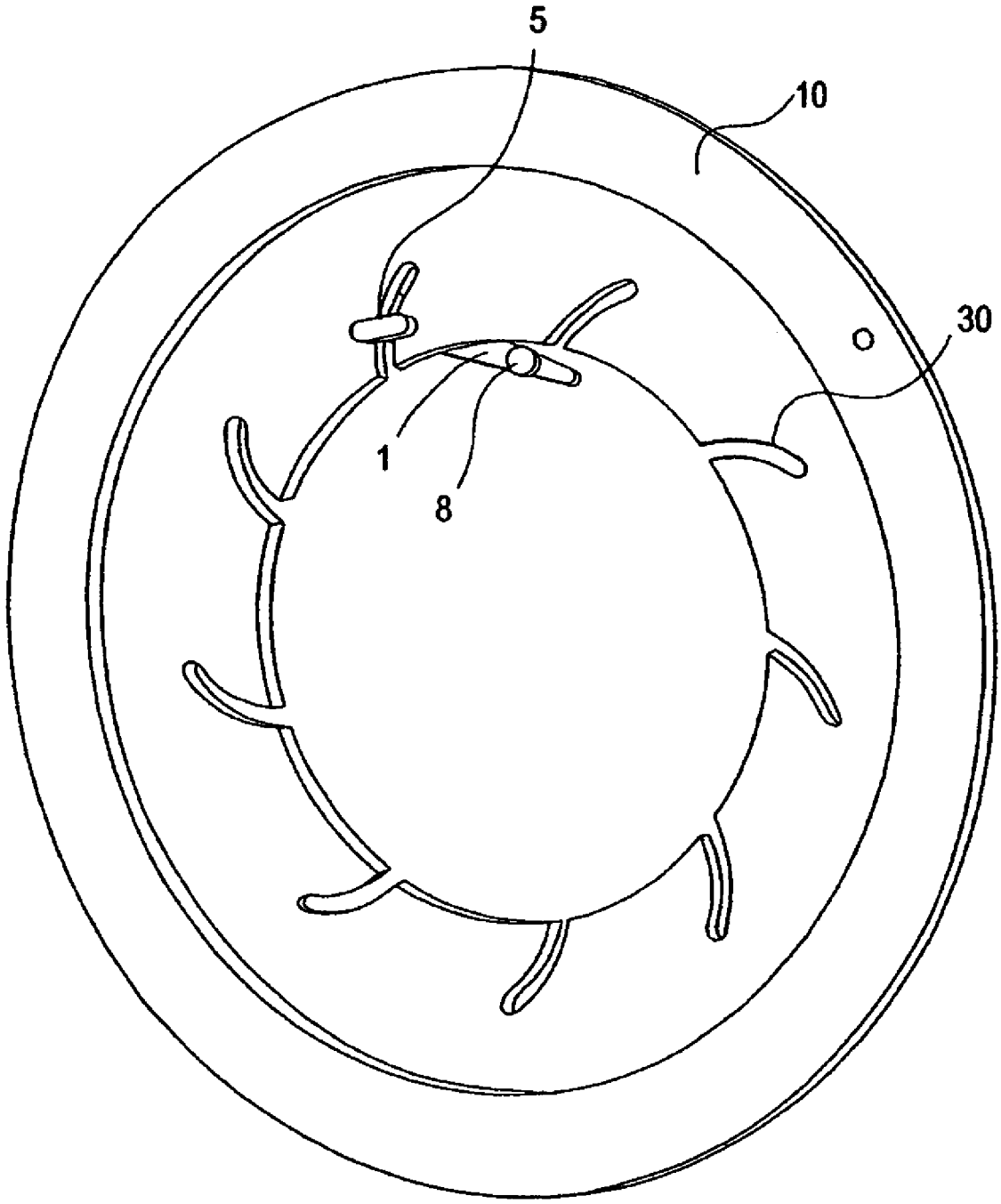
FIG. 9 shows the wall member of FIG. 8 with a vane mounted thereto.

The assembly of the variable nozzle device according to the embodiment of the present invention is explained based on FIGS. 8-11. FIG. 8 shows the wall member 10 without the remaining parts of the variable nozzle device being mounted thereto. As can be derived from FIG. 8, the guide slots 30 are open at the inner circumferential surface of the wall member. As first step, one of the vanes 1 is positioned at the wall member 10 such that the tab portion 5 of the tab member 9 of the vane 1 is slid into one of the guide slots 30 of the wall member 10. This procedure is performed for each of the vanes 1 corresponding to the respective guide slots 30. In this connection, the vanes are kept in a position such that the tab portion 5 is rotated so as to be directed in substantially perpendicular to the guide slots 30. By arranging the vanes 1 in the above-mentioned manner, the vanes are held on the wall member 10 by gripping the wall member between the tab member 5 and the vane body of the vane 1. A condition of one vane being mounted to the wall member 10 is shown in FIG. 9.

Figure 10:
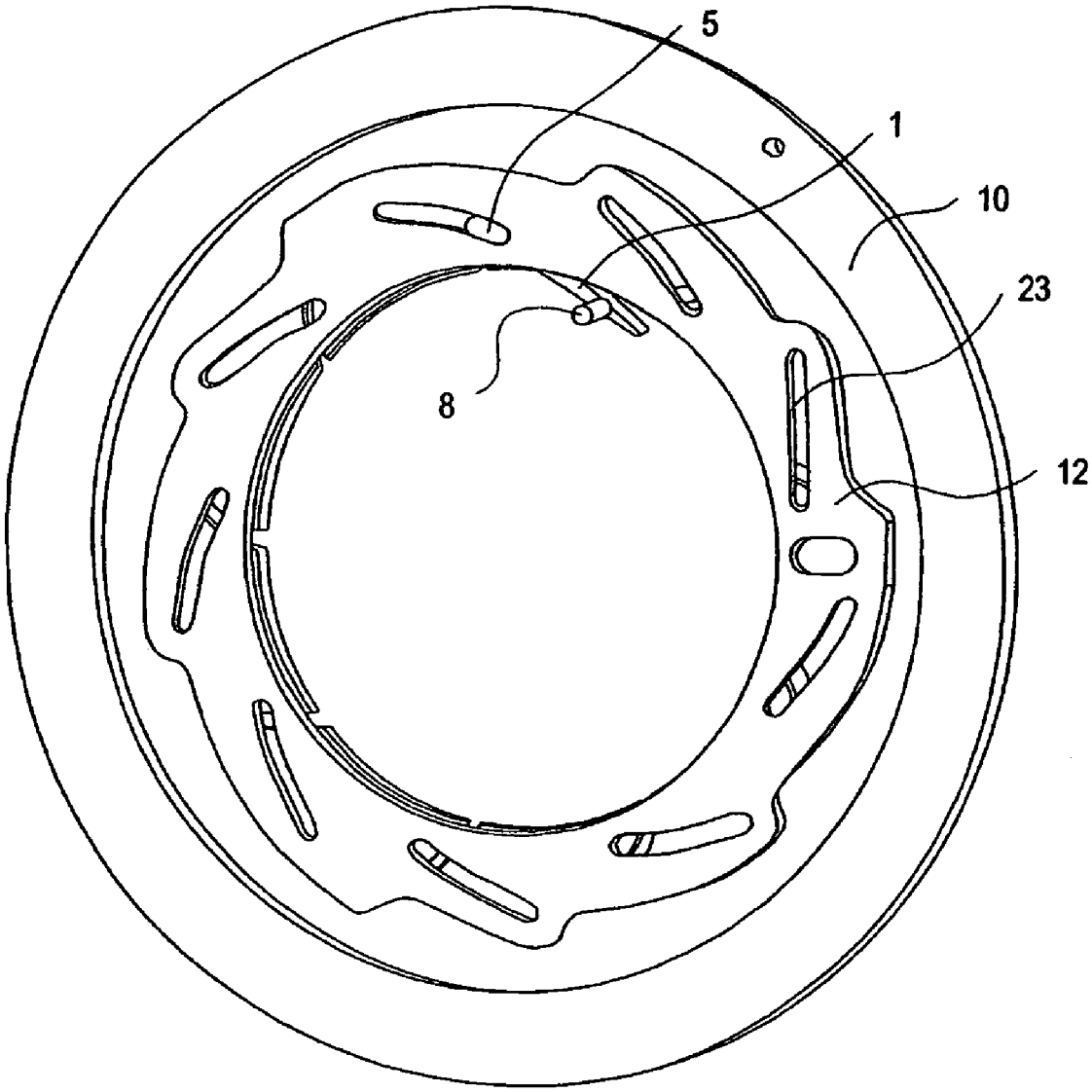
FIG. 10 shows the wall member of FIG. 8, the vane and the unison ring mounted thereto.
Figure 11:
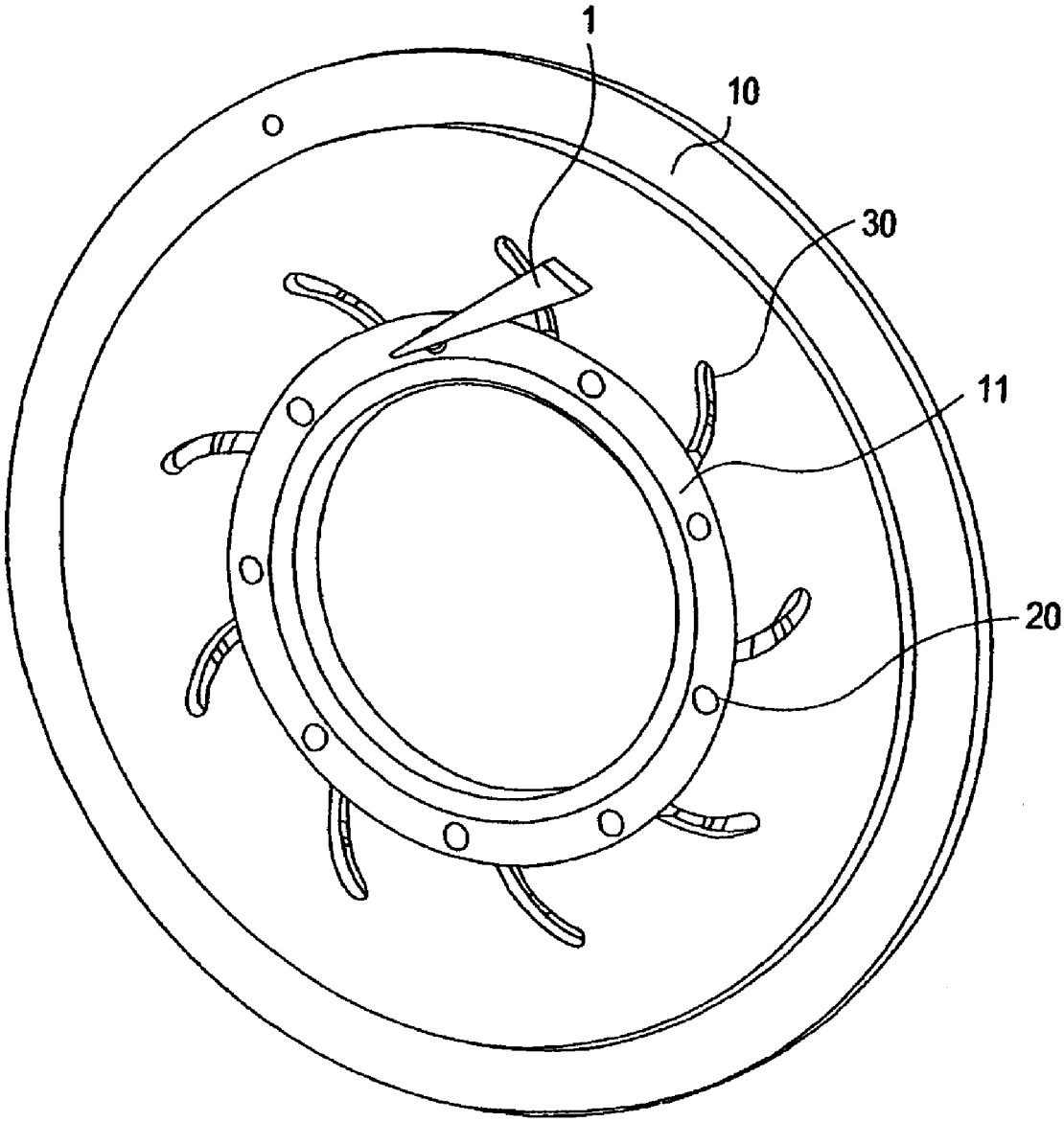
FIG. 11 shows the variable nozzle device in a mounted condition.

As shown in FIG. 10, the unison ring 12 is put into the recess on one side of the wall member 10. The unison ring is arranged such that the tab portion 5 of the vane 1 is accommodated in a respective actuating slot 23. In FIG. 10, only one vane 1 is shown. However, all vanes 1 are mounted to the wall member and rotated such that the tab member 5 can be accommodated in the actuating slots 23 of the unison ring 12. In this condition, the vanes 1 are positioned by the engagement of the tab portions 5 and the actuating slots 23. That is, the pivot axles 8 of each of the vanes 1 are positioned such that the insert 11 can be mounted to the variable nozzle device while accommodating the pivot axles 8 in the respective holes 20.

In other words, the insert 11 is press-fitted into the inner circumferential surface of the wall member 1 while enabling the pivot axles 8 to be accommodated in the respective holes 20. This can be facilitated by using a specific jig or any other device which maintains the relative position of the vanes 1, the unison ring 12 and the wall member 10. Then, the insert 11 is press-fitted from the side of the unison ring towards the side on which the vane bodies of the vanes 1 are arranged. In the process of press-fitting of the insert 11 into the inner circumferential surface of the wall member 10, the stepped surface 15 slides on the inner circumferential surface of the wall member 10. Further promoting the press-fitting operation results in an abutment of the step 17 with the axial side of the wall member 10. In this condition, the surface formed by the wall member 10 and the insert 11 does not comprise any steps on the side vane bodies of the vanes 1 are arranged. That is, the wall member 10 and the insert 11 are flush.

Referring back to FIG. 2, the mounted condition is achieved by positioning the insert 11 up to the limit position where the step 17 is pressed against the wall member 10. Furthermore, the unison ring is slidably held on the outer circumferential surface of the insert 11*a*. In addition, the flange 11*b* is in contact with the unison ring in order to hold the unison ring 12 axially. That is, the unison ring is prevented from falling off by the flange 11*b* formed at the insert 11.

Although the variable nozzle device of the embodiment according to the present invention is formed by the insert 11 in addition to the remaining parts, an integrally formed vane member including the tab member 9 in one body can be employed. Furthermore, the insert 11 serves as mounting means for mounting the unison ring which is to be supported rotatably and axially immovable.

An operation mode of the variable nozzle device is described in the following based on FIGS. 4 and 5. With the vanes 1 being mounted to the wall member 10, the tab portion 5 of the tab member 9 is guided in the actuating slots 23 of the unison ring 12 while the shaft portion 6 is guided in the guide slots 30 of the wall member 10. FIG. 5 shows the position where the vanes 1 are closed, since said portions 5 are arranged in the radially inner limit position of the actuating slots 23 of the unison ring 12.

When the unison ring 12 is rotated with respect to the wall member 10 in the clockwise direction as seen in FIG. 5, the actuating slot 23 exerts a force to the tab portion 5 of the tab member 9 which urges the tab member 9 towards the radial outward side of the insert 10 while the shaft portion 6 of the tab member 9 is allowed to slide within the guide slots 30 of the wall member 10. Accordingly, the vane 1 is moved to its opened limit position with the shaft portion 6 sliding in the guide slot 30. In the fully opened state of the vane 1, the tab portion 5 is located at the radial outer end of the actuating slot 23 of the unison ring while the shaft portion 6 is located at the radial outer end of the guide slots 30.

Thus, a variable nozzle device comprising the wall member 10, the unison ring 12 and the insert 11 as separate member as well as a plurality of vanes 1 which are provided as integral part is provided in the form of a preassembled cartridge.

A cartridge as described above can be used with a compressor of a turbocharger. The turbocharger is mounted directly at the exhaust manifold where exhaust gases pass a turbine impeller that is arranged on a shaft.

On the other side of this shaft, a compressor wheel is provided and driven by this turbine via the shaft. A compressor wheel is located in a housing and draws suction air through an air filter, compresses this suction air and supplies the same into an intake manifold of the engine via a volute in the housing. Thus, energy from the exhaust gases, which would be exhausted without being used, is employed to supply additional and boosted air into the combustion engine into an increased engine power and an enhanced efficiency of the entire system.

Since the cartridge formed by the variable nozzle device is manufactured as a subassembly, the vanes 1 of the cartridge are fully calibrated and after the cartridge has been attached to the volute, the system can be aerodynamically tested, e.g. by using a certain testing device, before being attached to the housing 50.

The basic concept of the present invention consists in that the vanes are rotatably/slidably held at two positions, wherein one position is arranged on one element formed by the wall member 10 and the other position is arranged on an element formed by insert 11 which is a separate element. Thereby, simplified vanes can be employed which are formed from a single part e.g. by casting or the like. That is, in the course of the assembly of the variable nozzle device, the vanes 1 including a pivot axle 8 and the tab member 9 do not have to be further machined or assembled. Rather, the integrally formed vanes 1 are arranged on the wall member 10 and the unison ring 12 and the vanes are mounted by press-fitting the insert 11 to the wall member.

As a result, the variable nozzle device can be formed by a less number of components while enhancing the function and response behaviour thereof. Furthermore, a failure due to a damage of a vane which is formed by assembling a plurality of parts can be prevented.

Preferably, this variable nozzle device according to the invention is used for compressor housings a deformation of which does not largely affect a gap between the vanes and the diffuser face.

In the forgoing, a preferred embodiment of the invention has been described with reference to the drawings. However, it will be apparent to a person skilled in the art that further modifications can be carried out without departing from the scope of the claims.

For example, the vane 1 is formed integrally according to the preceding embodiment of the present invention. However, a vane construction can be employed which is formed by separate elements in advance. In particular, a vane construction can be employed in which the tab portion and the shaft portion are mounted to the vane body of vane 1 in advance of being mounted to the variable nozzle device. The invention is most effective when the vanes 1 are employed which are formed integrally.

A number of vanes and, thus, the number of assembly slots, pivot holes, actuating slots in the unison ring etc. is not restricted but can be adapted to the individual requirements.

Furthermore, the shape of the vanes can be advantageously be adapted. For example, apart from a triangular shape, the vanes may e.g. have a curved shape or the longer edges of the vanes may be substantially parallel to each other.

Although the nozzle device was described as a compressor nozzle device, it will be obvious to a person skilled in the art to use an equivalent nozzle device for a turbine, e.g. on a turbine side of a turbocharger.

Furthermore, the nozzle device is not restricted to the use with a turbocharger, but it is suitable for any apparatus where fluids pass a flow path having a variable sectional area.

The invention claimed is:

1. A variable nozzle device comprising:

a wall member;

a unison ring; and a plurality of vanes rotatable about a pivot axle by said unison ring, wherein each vane has a tab member comprising a shaft portion and a tab portion for holding said vane on said wall member; and an insert for supporting said vane rotatably about said pivot axle, wherein said wall member comprises guide slots for guiding said shaft portions of said vanes.

2. A variable nozzle device according to claim 1, wherein said insert is formed as separate element.

3. A variable nozzle device according to claim 2, wherein said insert is press-fitted to said wall member.

4. A variable nozzle device according to claim 2, wherein said insert is arranged radially inside of said wall member.

5. A variable nozzle device according to claim 2, wherein said insert comprises holes for rotatably supporting said pivot axles.

6. A variable nozzle device according to claim 1, wherein said tab portions are insertable through said guide slots and capable of abutting against said wall member so as to restrict a movement of said vanes relative to said wall member in the axial direction with respect to said shaft portions.

7. A variable nozzle device according to claim 1, wherein said guide slots are open towards the inner circumferential surface of said wall member.

8. A variable nozzle device comprising:

a wall member;

a unison ring; and a plurality of vanes rotatable about a pivot axle by said unison ring, wherein each vane has a tab member comprising a shaft portion and a tab portion for holding said vane on said wall member; and an insert for supporting said vane rotatably about said pivot axle, wherein said tab portions protrude from said wall member on the side opposite to the vanes and are engageable with said unison ring.

9. A variable nozzle device according to claim 8, wherein said unison ring comprises actuating slots for engaging with said tab portions in order to actuate said vanes by rotating said unison ring relatively to said wall member.

10. A variable nozzle device according to claim 9, wherein said tab portions are formed with a shape which corresponds to the shape of said actuating slots.

11. A variable nozzle device comprising:

a wall member;

a unison ring; and a plurality of vanes rotatable about a pivot axle by said unison ring, wherein each vane has a tab member comprising a shaft portion and a tab portion for holding said vane on said wall member; and an insert for supporting said vane rotatably about said pivot axle, wherein an inner circumferential surface of unison ring is in sliding contact with an outer circumferential surface of said insert, and wherein said insert comprises a flange protruding from said outer circumferential surface of said insert wherein the diameter of said inner circumferential surface of said unison ring is smaller than the outer diameter of said flange.

12. A variable nozzle device comprising:

a wall member;

a unison ring; and a plurality of vanes rotatable about a pivot axle by said unison ring, wherein each vane has a tab member comprising a shaft portion and a tab portion for holding said vane on said wall member; and an insert for supporting said vane rotatably about said pivot axle, wherein said insert is formed as separate element, and wherein said insert is arranged radially inside of said wall member, and wherein said insert comprises a stepped surface the diameter of which is smaller than that of the outer circumferential surface of the insert, wherein said stepped surface is engaged with the inner circumferential surface of said wall member.

13. A variable nozzle device according to claim 12, wherein a step formed axially between said stepped surface and said outer circumferential surface of said insert, wherein said step is in abutment with said wall member.

14. A variable nozzle device comprising:

a wall member;

a unison ring; and a plurality of vanes rotatable about a pivot axle by said unison ring, wherein each vane has a tab member comprising a shaft portion and a tab portion for holding said vane on said wall member; and an insert for supporting said vane rotatably about said pivot axle, wherein said tab member comprising said shaft portion and said tab portion are formed integrally with the vane.

15. A turbocharger comprising:

a compressor including a wall member;

a unison ring; and a plurality of vanes rotatable about a pivot axle by said unison ring, wherein each vane has a tab member comprising a shaft portion and a tab portion for holding said vane on said wall member; and an insert for supporting said vane rotatably about said pivot axle, wherein said wall member comprises guide slots for guiding said shaft portions of said vanes.

* * * * *